US006089762A

United States Patent [19]

Mimasaka et al.

[11] Patent Number: 6,089,762

[45] Date of Patent: Jul. 18, 2000

[54] DEVELOPING APPARATUS, DEVELOPING METHOD AND SUBSTRATE PROCESSING APPARATUS

[75] Inventors: Masahiro Mimasaka; Koji Uchitani, both of Kyoto, Japan

[73] Assignee: Dainippon Screen Mfg. Co., Ltd., Kyoto, Japan

[21] Appl. No.: 09/062,475

[22] Filed: Apr. 17, 1998

[30] Foreign Application Priority Data

Apr. 28, 1997 [JP] Japan ..... 9-110817
Nov. 28, 1997 [JP] Japan ..... 9-328631

[51] Int. Cl.[7] ..... G03D 5/00

[52] U.S. Cl. ..... 396/611; 396/627

[58] Field of Search ..... 396/604, 611, 396/627; 118/52, 319, 323; 134/902, 153; 427/345

[56] References Cited

U.S. PATENT DOCUMENTS 5,252,137 10/1993 Tateyama et al. ..... 134/34
5,489,337 2/1996 Nomura et al. ..... 118/667
5,871,584 2/1999 Tateyama et al. ..... 118/323
5,984,540 11/1999 Minasaka et al. ..... 396/604

FOREIGN PATENT DOCUMENTS 2-141759 5/1990 Japan .
7-36194 2/1995 Japan .
10-020508 1/1998 Japan .

*Primary Examiner*—D. Rutledge
*Attorney, Agent, or Firm*—Ostrolenk, Faber, Gerb & Soffen, LLP

[57] ABSTRACT

The present invention provides a developing apparatus and a developing method which make it possible to uniformly develop a photosensitive film which is formed on a substrate at a high throughput. A substrate processing apparatus which comprises such a developing apparatus and a developing method is also realized. During developing processing, a substrate is held still by a substrate holding portion. A developing solution dispensing nozzle moves over the substrate, linearly from a position off and on one side of the substrate to a position off and on the other side of the substrate in a scanning direction (A), and supplies a developing solution onto the substrate. After the developing solution dispensing nozzle moves in the scanning direction (A), a substrate transport apparatus replaces the substrate which is held by the substrate holding portion with another substrate. Following this, the developing solution dispensing nozzle moves over the substrate, linearly from the position off and on the other side of the substrate to the position off and on the one side of the substrate in an opposite scanning direction (D) to the scanning direction (A), and supplies the developing solution onto the substrate.

21 Claims, 8 Drawing Sheets

DEVELOPING APPARATUS, DEVELOPING METHOD AND SUBSTRATE PROCESSING APPARATUS

BACKGROUND OF THE INVENTION

1. Field of the Invention

The present invention relates to a developing apparatus and a developing method in which a developing solution is supplied onto a photosensitive film which is formed on a substrate and developing processing is performed. The present invention also relates to a substrate processing apparatus.

2. Description of the Background Art

A developing apparatus is used to develop a photosensitive film which is formed on a substrate such as a semiconductor wafer, a glass substrate for liquid crystal device, a glass substrate for photomask and an optical disk.

For example, a developing apparatus of spin type comprises a spin/hold portion for holding a substrate horizontally and rotating the substrate about a vertical axis, and a developing solution dispensing nozzle for supplying a developing solution to a surface of the substrate. The developing solution dispensing nozzle is attached to a tip end of a nozzle arm which is disposed for free rotation within a horizontal plane, and can move between an upper position above the substrate and a standby position.

During developing processing, after the developing solution dispensing nozzle moves to a position above the substrate from the standby position, a developing solution is supplied onto the photosensitive film which is formed on the substrate. The developing solution which is supplied spreads out over the entire surface of the substrate and contacts the photosensitive film as the substrate is rotated. The substrate, as it holds the developing solution thereon (i.e., with the developing solution built up on the substrate) due to the surface tension of the developing solution, is kept still for a certain period of time, whereby the photosensitive film is developed. After the supply of the developing solution is completed, the developing solution dispensing nozzle moves to the standby position from the position above the substrate as the nozzle arm revolves.

If the developing solution in the vicinity of a dispensing opening of the developing solution dispensing nozzle is exposed to air, the concentration of the developing solution changes because of evaporation of moisture contained in the developing solution, and the properties of the developing solution change because of the contact of the developing solution with air. Hence, before the developing processing, the developing solution near the dispensing opening of the developing solution dispensing nozzle is released and expelled (i.e., pre-dispensing) in advance at the standby position, so that the developing solution which is supplied into the developing solution dispensing nozzle is homogenized.

However, in the conventional developing apparatus of spin type described above, when the developing solution hits the rotating substrate at the start of the dispensing of the developing solution, the photosensitive film on the substrate is subjected to a large impact. The impact creates air bubbles in the developing solution, and fine air bubbles which remain at a surface of the photosensitive film become development defects in some cases. Further, the impact of the developing solution at the start of the dispensing may damage the photosensitive film.

In addition, after the pre-dispensing, while the developing solution dispensing nozzle moves to the position above the substrate from the standby position, the developing solution in the vicinity of the dispensing opening of the developing solution dispensing nozzle contacts air. Due to this, it is possible that the properties of the developing solution which is supplied onto the substrate immediately after the start of the dispensing will change somewhat from those of the developing solution which is supplied successively and subsequently. Hence, development defects may be created on the substrate which contacts the developing solution which is supplied immediately after the start of the dispensing. Further, there is a possibility that the developing solution will dry out due to contact with air and the dried developing solution will adhere on the substrate as particles.

Moreover, since the developing solution becomes inhomogeneous during a process in which the developing solution which drops onto the substrate spreads out over the entire surface of the substrate because of centrifugal force, it is necessary to supply a large quantity of the developing solution before the developing solution on the substrate becomes homogeneous.

Noting the above, the inventor of the present invention proposed a developing method in which the developing solution is supplied onto a stationary substrate while the developing solution dispensing nozzle scans passing over the substrate linearly from a position off and on one side of the substrate to a position off and on the other side of the substrate. Although it is possible to uniformly develop a photosensitive film which is formed on a substrate with a small quantity of a developing solution according to this developing method, a further improvement in the throughput of the developing processing is desired.

SUMMARY OF THE INVENTION

The present invention is directed to an apparatus for supplying a developing solution to a substrate and performing developing processing.

An apparatus for supplying a developing solution to a substrate and performing developing processing comprises: a) substrate holding means for holding a substrate horizontally; b) a developing solution dispensing nozzle for dispensing a developing solution onto the substrate; c) moving means for reciprocally moving the developing solution dispensing nozzle over the substrate which is held still by the substrate holding means, between a one side position off the substrate and an other side position off the substrate; and d) control means for controlling the developing solution dispensing nozzle to dispense or stop dispensing the developing solution while the developing solution dispensing nozzle is moved forward and backward by the moving means.

The developing solution is supplied uniformly onto the substrate which is held by the substrate holding means while the developing solution dispensing nozzle moves forward and backward, and a photosensitive film which is formed on the substrate is developed uniformly. Hence, by replacing the substrate which is held by the substrate holding means sequentially when the developing solution dispensing nozzle moves forward and when the developing solution dispensing nozzle moves backward, it is possible to enhance the throughput of the developing processing.

In a preferred aspect of the present invention, the developing solution dispensing nozzle comprises a bottom surface which is parallel to a substrate which is held still by the substrate holding means.

The developing solution which is dispensed upon the substrate spreads out along a gap between the bottom surface and the substrate as the surface tension of the developing solution becomes small, whereby the developing solution is supplied uniformly on the substrate, and consequently, the uniformity of the development is improved.

In other further preferred aspect of the present invention, the bottom surface is formed by a hydrophilic material.

By the time the developing solution dispensing nozzle reaches an edge of the substrate, a sufficient quantity of a solution pool is formed on the bottom surface. This prohibits the top surface of the substrate from having any portion which is not provided with the developing solution, and improves the uniformity of the development.

In still other further preferred aspect of the present invention, the dispensing direction changing means tilts the dispensing direction, in which the developing solution dispensing nozzle dispenses the developing solution, to an opposite direction to a traveling direction of the developing solution dispensing nozzle from a vertical downward direction.

It is possible to change the dispensing direction, in which the developing solution dispensing nozzle dispenses the developing solution, to an appropriate direction between when the developing solution dispensing nozzle moves forward and when the developing solution dispensing nozzle moves backward. Hence, it is possible to supply the developing solution onto the substrate in a proper condition, either while the developing solution dispensing nozzle moves forward or while the developing solution dispensing nozzle moves backward.

The present invention is also directed to a method of dispensing a developing solution at a developing solution dispensing nozzle and supplying the developing solution onto a substrate which is held by substrate holding means.

The present invention is also directed to a substrate processing apparatus or applying predetermined processing, including developing processing, to a substrate.

Accordingly, an object of the present invention is to provide a developing apparatus and a developing method which make it possible to uniformly develop a photosensitive film which is formed on a substrate at a high throughput.

A further object of the present invention is to provide a substrate processing apparatus which comprises a developing apparatus which uniformly develops a photosensitive film which is formed on a substrate at a high throughput.

These and other objects, features, aspects and advantages of the present invention will become more apparent from the following detailed description of the present invention when taken in conjunction with the accompanying drawings.

DESCRIPTION OF THE PREFERRED EMBODIMENTS

<A. First Preferred Embodiment>

Figure 1:
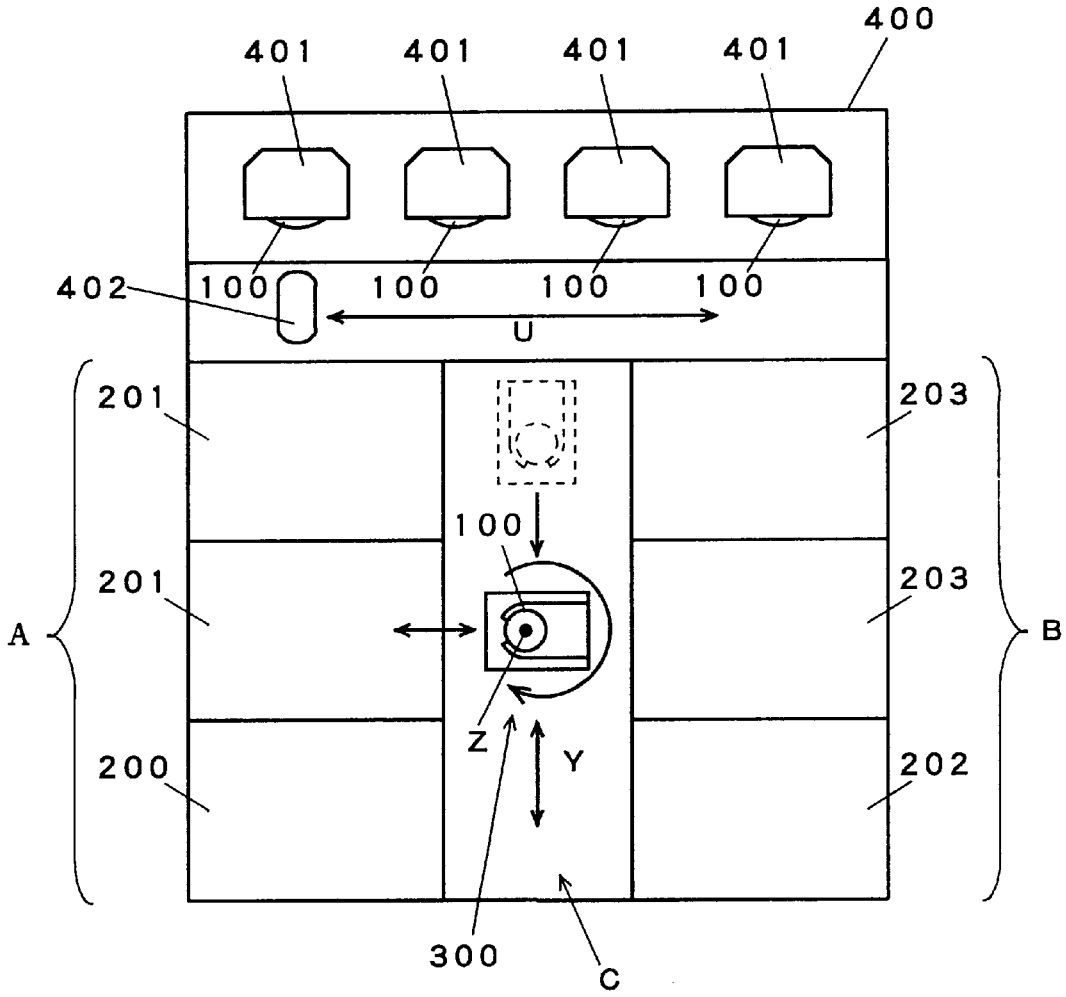
FIG. 1 is a plan view of a substrate processing apparatus which comprises a developing apparatus according to a first preferred embodiment of the present invention.

FIG. 1 is a plan view of a substrate processing apparatus which comprises a developing apparatus according to a first preferred embodiment of the present invention.

The substrate processing apparatus shown in FIG. 1 comprises processing areas A, B and a transportation area C. In the processing area A, a developing apparatus 200 according to the first preferred embodiment for developing a substrate and spin coating apparatuses 201 for coating a substrate with a processing solution such as a photoresist solution are arranged parallel to each other. Meanwhile, in the processing area B, heating units (i.e., hot plates) 202 for heating a substrate and cooling units (i.e., cooling plates) 203 for cooling a substrate are disposed in a plurality of stages. In the transportation area C, a substrate transport apparatus 300 is disposed.

A load/unload apparatus (i.e., an indexer) 400 for housing substrates 100 while loading and unloading a substrate 100 is disposed on one end of the processing areas A, B and the transportation area C. The load/unload apparatus 400 comprises a plurality of cassettes 401 which house substrates 100 and a transfer robot 402 which loads and unloads a substrate 100. Moving in the direction of the arrow U, the transfer robot 402 of the load/unload apparatus 400 takes out a substrate 100 from the cassettes 401 and transfers the substrate 100 to the substrate transport apparatus 300, or receives a substrate 100 which has been already processed through a series of processing from the substrate transport apparatus 300 and returns the substrate 100 to the cassettes 401.

The substrate transport apparatus 300 is disposed so as to be movable in a horizontal direction which is indicated at the arrow Y and a vertical direction and also to be rotatable about a vertical axis Z within the transportation area C. In addition, the substrate transport apparatus 300 is capable of moving toward each one of the processing units, such as the developing apparatus 200 and the spin coating apparatuses 201, and backward from each such processing unit. Hence, in the transportation area C, the substrate transport apparatus 300 transports substrates 100 in the direction of the arrow Y, loads and unloads substrates to and from the respective processing units, and transfers substrates 100 by means of the transfer robot 402.

Figure 2:
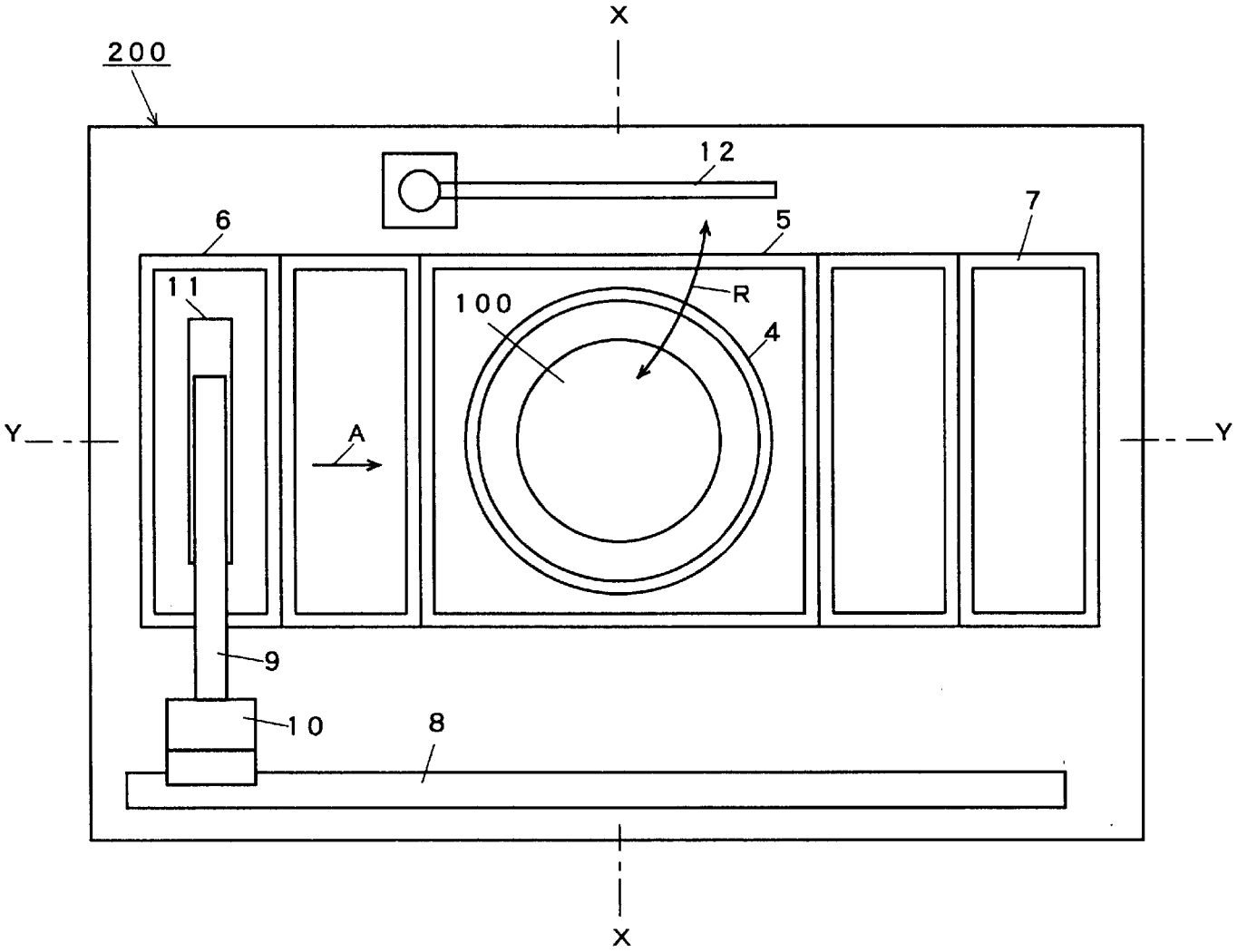
FIG. 2 is a plan view of the developing apparatus within the substrate processing apparatus of FIG. 1.
Figure 3:
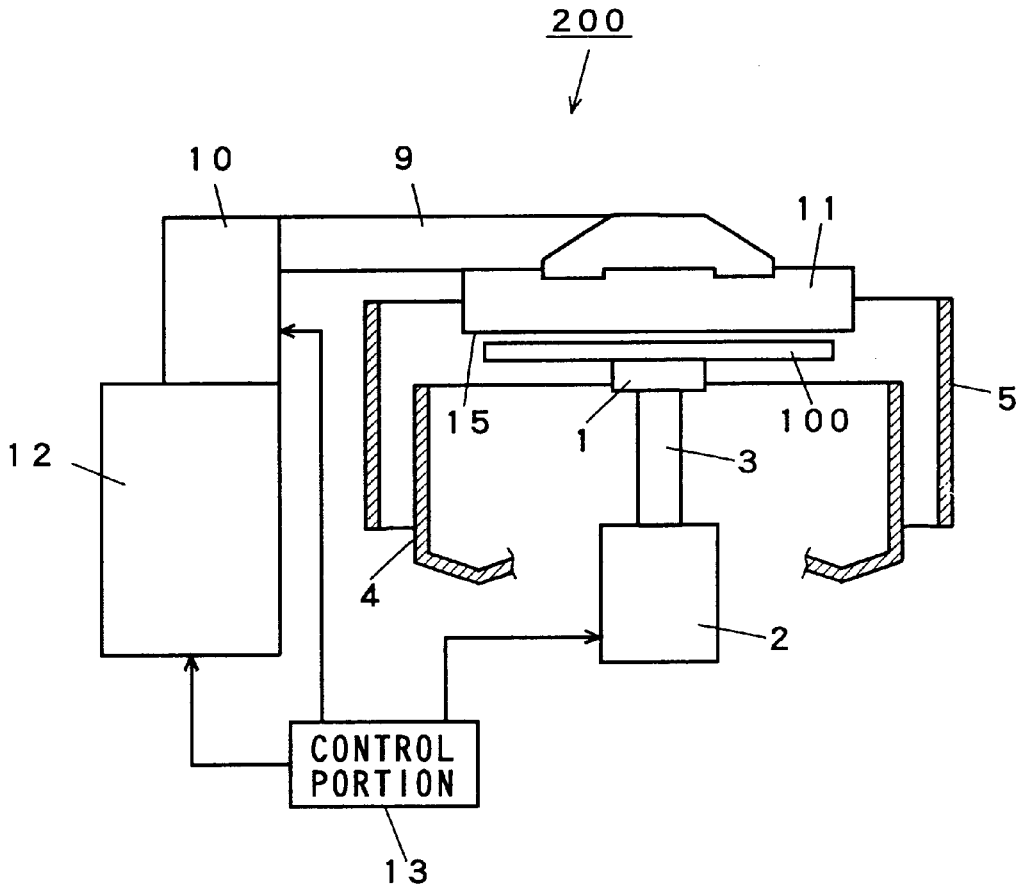
FIG. 3 is a cross sectional view of a principal portion of the developing apparatus of FIG. 2 taken along the X—X line.
Figure 4:
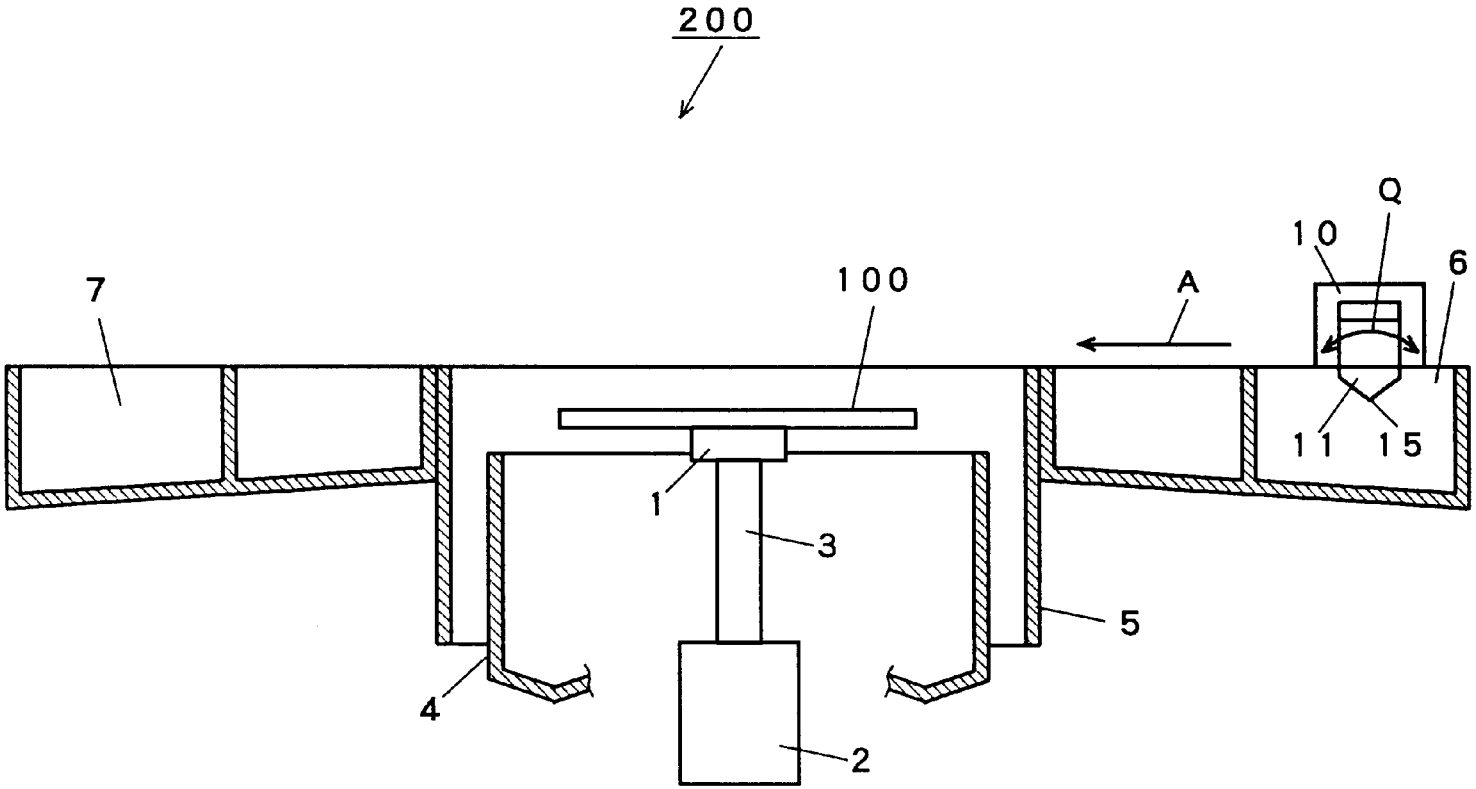
FIG. 4 is a cross sectional view of the principal portion of the developing apparatus of FIG. 2 taken along the Y—Y line.

FIG. 2 is a plan view of the developing apparatus within the substrate processing apparatus which is shown in FIG. 1, FIG. 3 is a cross sectional view of a principal portion of the developing apparatus which is shown in FIG. 2 taken along the X—X line, and FIG. 4 is a cross sectional view of the principal portion of the developing apparatus which is shown in FIG. 2 taken along the Y—Y line.

As shown in FIGS. 3 and 4, the developing apparatus 200 comprises a substrate holding portion 1 which sucks and horizontally holds a substrate 100. The substrate holding portion 1 is fixed to a tip end portion of a rotation shaft 3 of a motor 2, for free rotation about the shaft which extends in the vertical direction. Around the substrate holding portion 1, a circular inner cup 4 is disposed to surround a substrate 100 for free upward and downward movement. A square outer cup 5 is disposed around the inner cup 4.

As shown in FIG. 2, standby pots 6, 7 are arranged on the both sides of the outer cup 5, and a guide rail 8 is disposed on one side of the outer cup 5. Further, a nozzle arm 9 is disposed so as to be movable in a scanning direction A and an opposite direction along the guide rail 8 when driven by an arm driving portion 10. On the other side of the outer cup 5, a pure water dispensing nozzle 12 for dispensing pure water is disposed so as to be revolvable in the direction of the arrow R.

A developing solution dispensing nozzle 11, which comprises a slit-like dispensing opening 15 which is formed in a bottom end portion of the developing solution dispensing nozzle 11, is attached to the nozzle arm 9 in a perpendicular direction to the guide rail 8. This allows the developing solution dispensing nozzle 11 to move over a substrate 100, linearly from the position of the standby pot 6 to the position of the standby pot 7 along and parallel to the scanning direction A, and to move linearly in and parallel to an opposite direction to the scanning direction A. As shown in FIG. 4, the developing solution dispensing nozzle 11 is structured to be able to revolve in the direction of the arrow Q. The nozzle arm 9 internally comprises a driving mechanism, such as a motor, for revolving the developing solution dispensing nozzle 11 in the direction of the arrow Q.

As shown in FIG. 3, a developing solution supplying system 12 supplies a developing solution to the developing solution dispensing nozzle 11. A control portion 13 controls rotation of the motor 2, scanning of the developing solution dispensing nozzle 11 by the arm driving portion 10, dispensing of a developing solution from the developing solution dispensing nozzle 11, and inclination of the developing solution dispensing nozzle 11.

In the first preferred embodiment, the substrate holding portion 1 corresponds to substrate holding means, the arm driving portion 10 corresponds to moving means, and the control portion 13 corresponds to control means. In addition, the nozzle arm 9 corresponds to dispensing direction changing means, and the substrate transport apparatus 300 corresponds to substrate replacing means.

Figure 5:
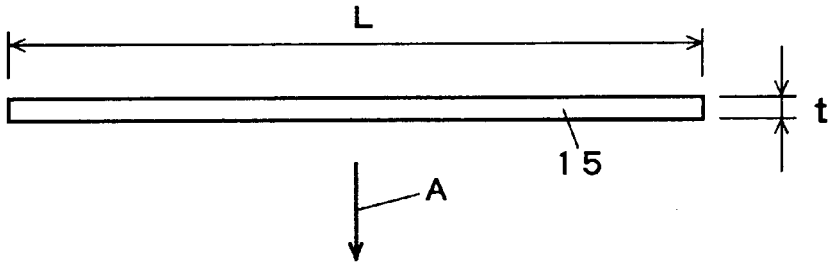
FIG. 5 is a view showing a slit-like dispensing opening of a developing solution dispensing nozzle.

FIG. 5 is a view showing the slit-like dispensing opening 15 of the developing solution dispensing nozzle 11. A slit width t of the slit-like dispensing opening 15 is 0.02 to 0.5 mm. In the first preferred embodiment, the slit width t is 0.1 mm. Further, a dispensing width L of the slit-like dispensing opening 15 is set to be equal to or larger than the diameter of a substrate 100 which is to be processed. The slit-like dispensing opening 15 is arranged perpendicularly to the scanning direction A in which of the developing solution dispensing nozzle 11 scans.

Figure 6:
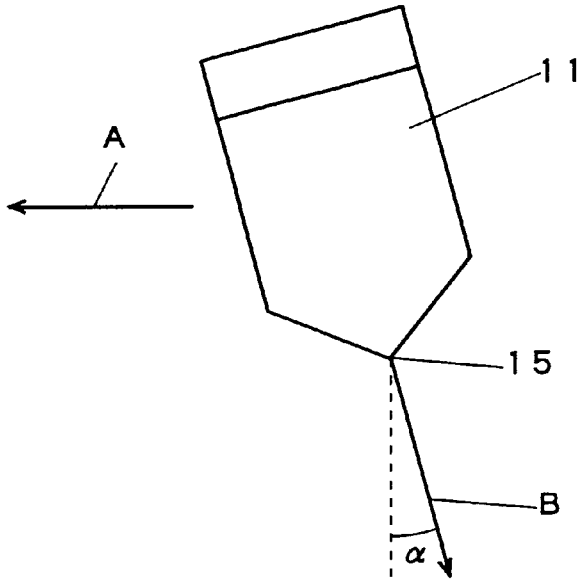
FIG. 6 is a side view showing a dispensing direction in which the developing solution dispensing nozzle dispenses a developing solution.

FIG. 6 is a side view showing a dispensing direction in which the developing solution dispensing nozzle 11 dispenses a developing solution. As shown in FIG. 6, during developing processing, the developing solution dispensing nozzle 11 is inclined such that a dispensing direction B for dispensing a developing solution changes from the normal direction of a substrate (i.e., a downward vertical direction) to an angle $\alpha$ toward the opposite side to the scanning direction A. The angle $\alpha$ is in the range of 20 to 30 decrees. In the first preferred embodiment, the angle $\alpha$ is set to 20 degrees.

In addition, the developing solution dispensing nozzle 11 scans, with a gap of 0.2 to 5 mm, more preferably, 0.2 to 1.0 mm between the slit-like dispensing opening 15 and a top surface of a substrate 100. In the first preferred embodiment, the gap between the slit-like dispensing opening 15 of the developing solution dispensing nozzle 11 and a top surface of a substrate 100 is set to 0.3±0.1 mm.

Next, an operation of the developing apparatus shown in FIG. 2 will be described with reference to FIGS. 7A through 7C. During the developing processing, a substrate 100 is held still by the substrate holding portion 1.

During a standbying period, the developing solution dispensing nozzle 11 standbys at a position P0 within the standby pot 6. During the developing processing, as shown in FIG. 7A, after moving upward, the developing solution dispensing nozzle 11 moves in the scanning direction A and descends at a scanning start position P1 within the outer cup 5.

Following this, at the scanning start position P1, before the developing solution dispensing nozzle 11 scans or upon scanning by the developing solution dispensing nozzle 11, the developing solution dispensing nozzle 11 starts dispensing a developing solution at a predetermined flow rate. In the first preferred embodiment, the flow rate of the developing solution is 1.5 L/min.

After the developing solution dispensing nozzle 11 started dispensing the developing solution or upon dispensing of the developing solution from the developing solution dispensing nozzle 11, the developing solution dispensing nozzle 11 starts to scan at the scanning start position P1 in the scanning direction A at a predetermined scanning speed. In the first preferred embodiment, the scanning speed is 10 to 500 mm/sec.

The developing solution dispensing nozzle 11 moves over a substrate 100 linearly in the scanning direction A, while dispensing the developing solution. As a result, the developing solution is supplied successively to the entire surface of the substrate 100. The supplied developing solution is held on the substrate 100 because of the surface tension of the developing solution.

After the developing solution dispensing nozzle 11 passed over the substrate 100, dispensing of the developing solution from the developing solution dispensing nozzle 11 is stopped at a dispensing stop position P2 which is off the substrate 100. Upon arrival of the developing solution dispensing nozzle 11 at a scanning stop position P3 within the outer cup 5, the developing solution dispensing nozzle 11 stops scanning.

Following this, after ascending to the scanning stop position P3, the developing solution dispensing nozzle 11 moves to a position P4 of the other standby pot 7 and descends within the standby pot 7.

The condition that the developing solution is supplied on the substrate 100 is maintained for a certain period of time, so that development of a photosensitive film which is formed on the substrate 100, such as a photoresist, progresses. At this stage, the motor 2 may drive the substrate holding portion 1 to rotate the substrate 100. Following this, the substrate 100 is rotated at a high speed while supplying pure water from the pure water dispensing nozzle 12 onto the substrate 100, whereby the developing solution on the substrate 100 is spun off. The substrate 100 is thereafter dried, thereby completing the developing processing.

Figure 7A:
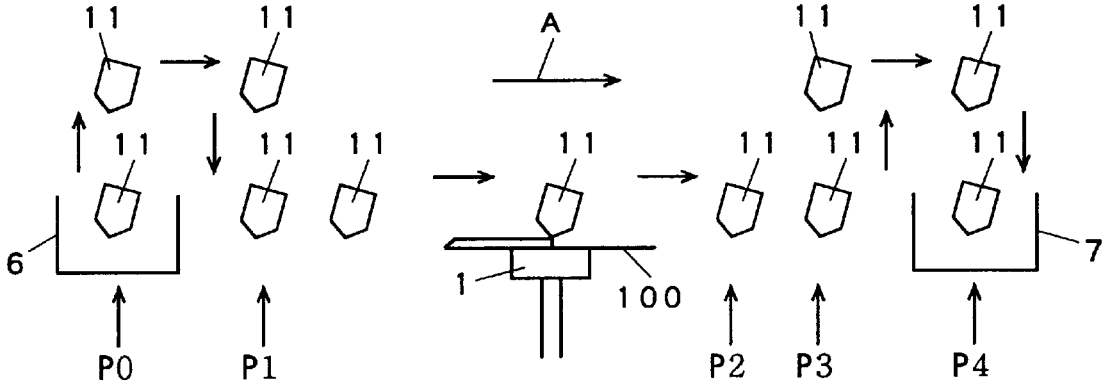
FIGS. 7A through 7C are views for describing an operation of the developing apparatus of FIG. 2.
Figure 7B:
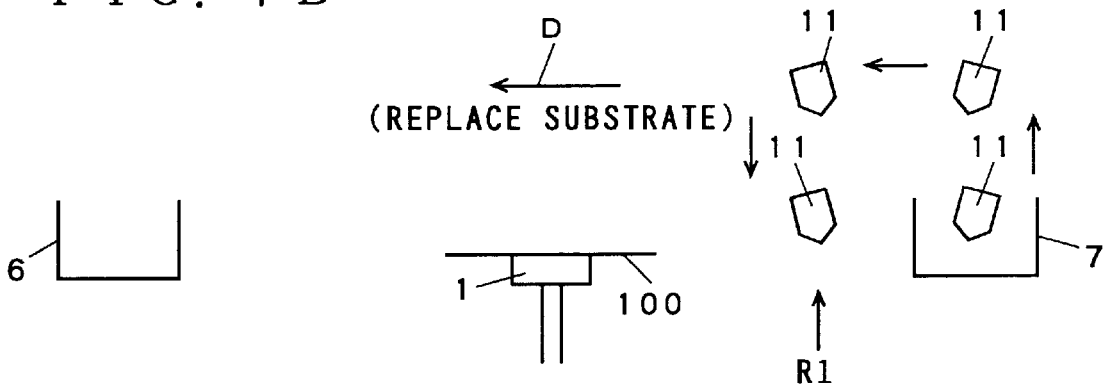

Following this, as shown in FIG. 7B, the substrate transport apparatus 300 shown in FIG. 1 replaces the substrate 100 which is currently held by the substrate holding portion 1. During this, after ascending from within the standby pot 7, the developing solution dispensing nozzle 11 moves in an opposite scanning direction D which is opposite to the scanning direction A shown in FIG. 7A, and descends at the next scanning start position R1 within the outer cup 5. At this stage, the developing solution dispensing nozzle 11 is tilted such that the dispensing direction for dispensing the developing solution changes from the downward vertical direction to the angle α described above toward the opposite side to the scanning direction D.

Figure 7C:
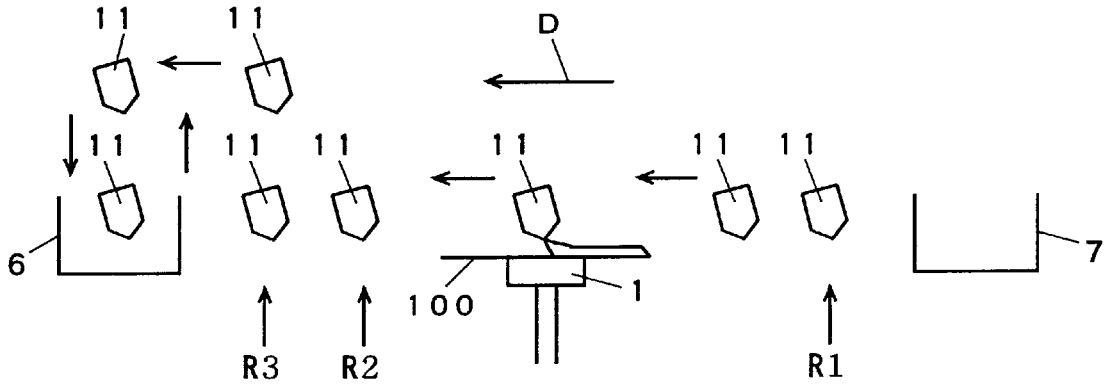

Next, as shown in FIG. 7C, at the scanning start position R1, before the developing solution dispensing nozzle 11 scans or upon scanning by the developing solution dispensing nozzle 11, the developing solution dispensing nozzle 11 starts dispensing the developing solution at a predetermined flow rate. In the first preferred embodiment, the flow rate of the developing solution is 1.5 L/min.

After the developing solution dispensing nozzle 11 started dispensing the developing solution or upon dispensing of the developing solution from the developing solution dispensing nozzle 11, the developing solution dispensing nozzle 11 starts scanning at the scanning start position R1 in the scanning direction D at a predetermined scanning speed. In the first preferred embodiment, the scanning speed is 10 to 500 mm/sec.

The developing solution dispensing nozzle 11 moves over a substrate 100 linearly in the scanning direction D, while dispensing the developing solution. As a result, the developing solution is supplied successively to the entire surface of the substrate 100. The surface tension of the developing solution holds the developing solution on the substrate 100.

After the developing solution dispensing nozzle 11 passed over the substrate 100, dispensing of the developing solution from the developing solution dispensing nozzle 11 is stopped at a dispensing stop position R2 which is off the substrate 100. Upon arrival of the developing solution dispensing nozzle 11 at a scanning stop position R3 within the outer cup 5, the developing solution dispensing nozzle 11 stops scanning.

Following this, after ascending to the scanning stop position R3, the developing solution dispensing nozzle 11 moves to the position of the other standby pot 6 and descends within the standby pot 6.

The condition that the developing solution is supplied on the substrate 100 is maintained for a certain period of time, so that development of a photosensitive film on the substrate 100 progresses. At this stage, as in the case described above, the motor 2 may drive the substrate holding portion 1 to rotate the substrate 100. Following this, the substrate 100 is rotated at a high speed while supplying pure water onto the substrate 100 from the pure water dispensing nozzle 12, whereby the developing solution on the substrate 100 is spun off. The substrate 100 is thereafter dried, thereby completing the developing processing.

Figure 8A:
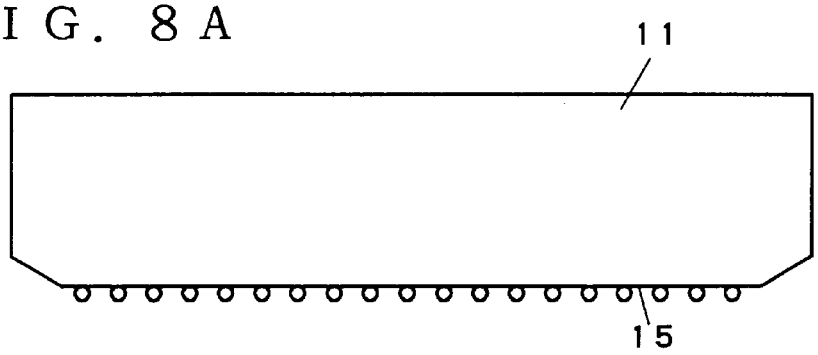
FIGS. 8A and 8B are front views showing a dispensing condition in which the developing solution dispensing nozzle dispenses a developing solution.
Figure 8B:
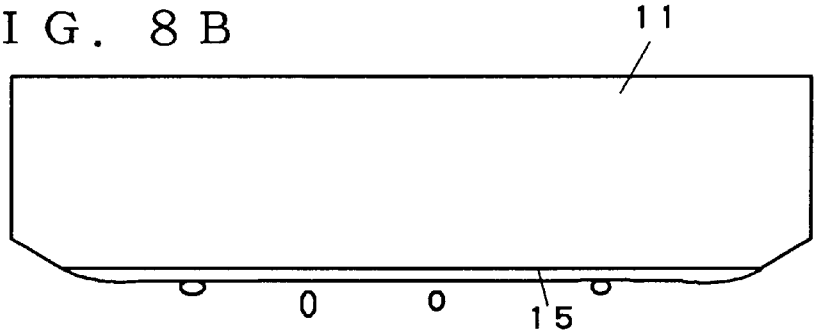

FIGS. 8A and 8B are front views showing a dispensing condition in which the developing solution dispensing nozzle 11 dispenses the developing solution. As shown in FIG. 8A, immediately after dispensed, the developing solution oozes out as a drop at the slit-like dispensing opening 15. After a certain period of time elapsed since the dispensing of the developing solution, as shown in FIG. 8B, drops of the developing solution join with each other, whereby the developing solution emerges as a band (curtain) along the slit-like dispensing opening 15.

The scanning start positions P1, R1 are set in such a manner that the scanning speed of the developing solution dispensing nozzle 11 reaches a predetermined speed before the developing solution dispensing nozzle 11 arrives at an edge of a substrate 100 since the start of scanning by the developing solution dispensing nozzle 11 and that a time is ensured which is necessary for the developing solution at the slit-like dispensing opening 15 to become like a band as shown in FIG. 8B.

Particularly since the developing solution dispensing nozzle 11 starts dispensing the developing solution at the scanning start positions P1, R1 before the developing solution dispensing nozzle 11 starts scanning or upon scanning by the developing solution dispensing nozzle 11, a sufficient time is ensured for the developing solution at the slit-like dispensing opening 15 to develop into a band before the developing solution dispensing nozzle 11 reaches an edge of a substrate 100. Hence, it is possible to place the scanning start positions P1, R1 close to the edge of the substrate 100. In the first preferred embodiment, the scanning start positions P1, R1 are set to positions about 10 to 100 mm from the edge of the substrate 100 respectively in the opposite directions to the scanning directions A, D.

Further, the dispensing start times at the scanning start positions P1, R1 are set in such a manner that a time is ensured which is necessary for the developing solution to become like a band before the developing solution dispensing nozzle 11 reaches an edge of a substrate 100, in accordance with the scanning speed of the developing solution dispensing nozzle 11 and the flow rate at which the developing solution is dispensed.

For example, since the developing solution dispensing nozzle 11 reaches an edge of a substrate 100 from the scanning start positions P1, R1 in a shorter period of time as the scanning speed becomes faster, the dispensing start times are set preceding the scanning start times.

In addition, since the developing solution which is being dispensed emerges as a band in a short period of time if the developing solution is dispensed at a large flow rate, it is possible to set the dispensing start times close to the scanning start times.

To reduce a wasteful use of the developing solution, it is desirable to set the dispensing start times for dispensing the developing solution close to the scanning start times to an extent that the developing solution is dispensed in the form like a band before the developing solution dispensing nozzle 11 reaches an edge of a substrate 100.

Figure 9:
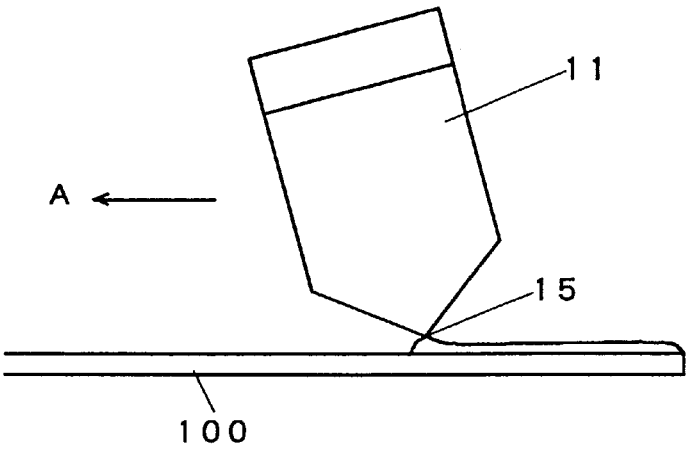
FIG. 9 is a side view showing the developing solution dispensing nozzle scanning over a substrate.

FIG. 9 is a side view showing the developing solution dispensing nozzle 11 scanning over a substrate 100. As described above, since the dispensing direction for dispensing the developing solution is inclined changing from the downward vertical direction to the opposite direction to the scanning direction A, a flow of the developing solution at a surface of the substrate 100 in the scanning direction A is suppressed, while a flow of the developing solution in the opposite direction to the scanning direction A is induced. As the flow of the developing solution in the scanning direction A is suppressed, the developing solution is prevented from flowing ahead the developing solution dispensing nozzle 11 in the scanning direction A, and therefore, the uniformity of development is improved. As the flow of the developing solution in the opposite direction to the scanning direction A is induced, fine bubbles called micro-bubbles which are contained in the developing solution are prevented from adhering to a surface of a photosensitive film which is formed on the substrate 100, so that creation of development defects is suppressed.

While the developing solution dispensing nozzle 11 is moving in the scanning direction D, an effect similar to the above is created if the dispensing direction for dispensing the developing solution is inclined changing from the downward vertical direction to the opposite direction to the scanning direction D.

In the developing apparatus according to the first preferred embodiment, the developing solution is supplied uniformly onto a substrate 100 which is held still by the substrate holding portion 1 while the developing solution dispensing nozzle 11 is moving forward in the scanning direction A, and after the substrate 100 is replaced with other substrate 100, while the developing solution dispensing nozzle 11 is moving back in the scanning direction D, the developing solution is supplied uniformly onto the other substrate 100 which is held still by the substrate holding portion 1. Thus, different substrates 100 are developed between when the developing solution dispensing nozzle 11 is moving forward and when the developing solution dispensing nozzle 11 is moving back, and therefore, the throughput of the developing processing is enhanced.

Further, since the developing solution dispensing nozzle 11 starts to dispense the developing solution at the scanning start positions P1, R1 for the developing solution dispensing nozzle 11, the developing solution which is dispensed at the start of dispensing is prevented from impacting a substrate 100. This suppresses creation of air bubbles in the developing solution, and hence, creation of development defects.

Further, at the scanning start positions P1, R1 for the developing solution dispensing nozzle 11, the developing solution which is near the slit-like dispensing opening 15 and contacts air is discharged off a substrate 100, and when the developing solution dispensing nozzle 11 comes above the substrate 100, a new developing solution is supplied onto the stationary substrate 100 from the developing solution dispensing nozzle 11. This prevents the developing solution with changed properties from creating development defects, and further prevents particles of a dried developing solution from adhering to a surface of a photosensitive film which is formed on the substrate 100.

Further, since dispensing of the developing solution is started at the scanning start positions P1, R1 for the developing solution dispensing nozzle 11, there is a sufficient time ensured for the developing solution which is dispensed out at the slit-like dispensing opening 15 to become like a band since the start of the dispensing of the developing solution by the developing solution dispensing nozzle 11 before the developing solution dispensing nozzle 11 reaches above a substrate 100. Hence, it is possible to place the scanning start positions P1, R1 for the developing solution dispensing nozzle 11 close to an edge of the substrate 100.

Still further, the developing solution dispensing nozzle 11 moves over a stationary substrate 100 linearly in a parallel direction, with the slit-like dispensing opening 15 and a top surface of the substrate 100 kept close to each other, and the developing solution which is in the form of a band at the slit-like dispensing opening 15 continuously contacts the surface of the substrate 100, and therefore, the developing solution is uniformly supplied onto the entire surface of the substrate 100 without impacting the surface of the substrate 100.

In addition, since the supply of the developing solution is continued until the developing solution dispensing nozzle 11 passes over a substrate 100, an impact which is created when the dispensing is stopped is prevented from exerting an adverse influence over the developing solution which is still in the process of building up. As a result, creation of development defects is suppressed while the uniformity of the linewidth of a pattern of a developed photosensitive film is improved.

Further, since the dispensing of the developing solution is stopped after the developing solution dispensing nozzle 11 passes over a substrate 100, the developing solution which drops down as the dispensing is stopped is prevented from impacting a photosensitive film which is formed on the substrate 100. This suppresses creation of development defects and a deterioration in the uniformity of the linewidth of a pattern of the photosensitive film.

Further, since the dispensing direction for dispensing the developing solution is inclined toward the opposite direction to the scanning direction, a flow of the developing solution at a surface of a substrate 100 in the scanning direction is suppressed while a flow of the developing solution in the opposite direction to the scanning direction is induced. This improves the uniformity of development and suppresses creation of development defects.

<B. Second Preferred Embodiment>

Next, a second preferred embodiment of the present invention will be described. A developing apparatus according to the second preferred embodiment is different from the developing apparatus according to the first preferred embodiment with respect to the configuration of the developing solution dispensing nozzle 11, but is otherwise the same as the developing apparatus according to the first preferred embodiment. Further, a structure of a substrate processing apparatus as a whole as well is similar to the structure of the substrate processing apparatus according to the first preferred embodiment which is shown in FIG. 1, except for the developing apparatus 200. Hence, a redundant description will be omitted.

Figure 10:
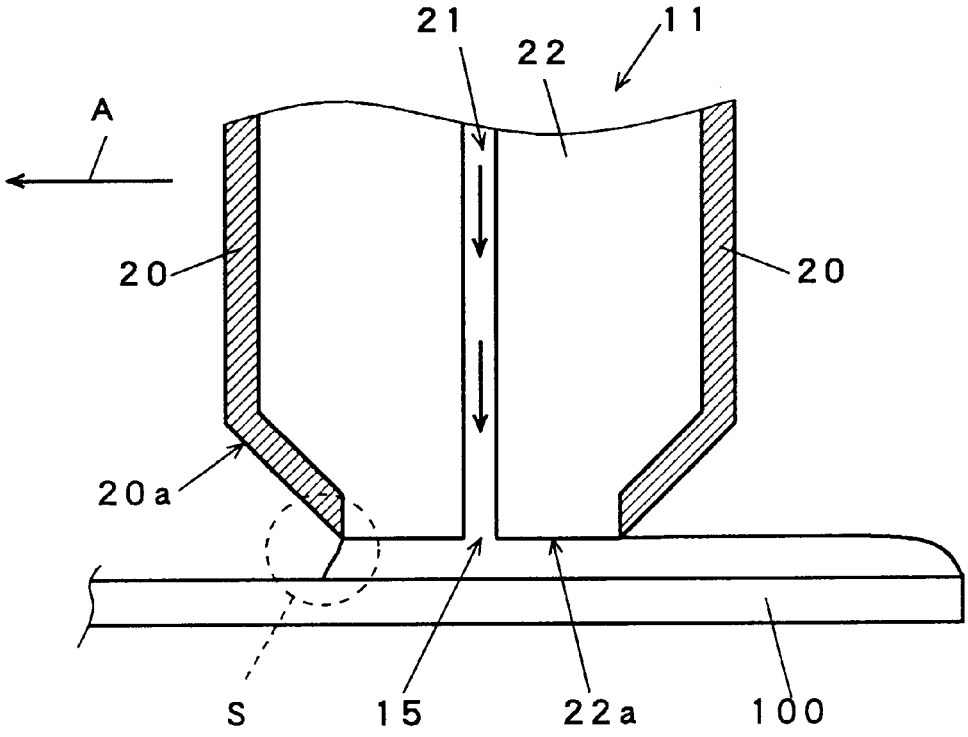
FIG. 10 is a cross sectional side view of a developing solution dispensing nozzle according to a second preferred embodiment.

FIG. 10 is a cross sectional side view of the developing solution dispensing nozzle 11 according to the second preferred embodiment. While a driving mechanism such as a motor is built in the nozzle arm 9 and the developing solution dispensing nozzle 11 is freely revolvable in the direction of the arrow Q in the first preferred embodiment (See FIG. 4), in the developing apparatus according to the second preferred embodiment, the nozzle arm 9 does not comprise a driving mechanism, and therefore, the developing solution dispensing nozzle 11 does not revolve. In short, the angle $\alpha$ at which the developing solution dispensing nozzle 11 is inclined is always 0 degree and the dispensing direction for dispensing the developing solution coincides with the normal direction of a substrate 100 (i.e., the vertical direction).

The nozzle main body portion 22 of the developing solution dispensing nozzle 11 according to the second preferred embodiment is formed by a hydrophilic material (such as quartz glass, pyrex glass and a ceramic material), and is coated at a side wall surface with a water-repellent material (such as a fluorine resin) so that a water-repellent layer 20 is formed. A bottom surface portion 22*a* of a nozzle main body portion 22 is a flat surface which is parallel to a substrate 100. Further, the water-repellent layer 20 is not formed in the bottom surface portion 22*a* of the nozzle main body portion 22, but is formed in the side wall surface of the developing solution dispensing nozzle 11 which is adjacent to at least the bottom surface portion 22*a*. In addition, of the water-repellent layer 20, at least an area which is adjacent to the bottom surface portion 22*a* is an inclined surface 20*a* which is inclined in such a manner that the inclined surface 20*a* is at an acute angle with respect to a substrate 100 which is held still by the substrate holding portion 1.

A developing solution supplying path 21 vertically penetrates at the center of the nozzle main body portion 22, and a bottom end portion of the developing solution supplying path 21 forms the slit-like dispensing opening 15 which is similar to that shown in FIG. 5. A developing solution which is supplied from the developing solution supplying system 12 flows through the developing solution supplying path 21 and is dispensed at the slit-like dispensing opening 15 onto a substrate 100. At dispensing, a gap between the slit-like dispensing opening 15 and a top surface of a substrate 100 is the same as the gap in the first preferred embodiment.

An operation of the developing solution dispensing nozzle 11 which has such a configuration above according to the second preferred embodiment is similar to the operation in the first preferred embodiment which is shown in FIG. 7A to FIG. 7C. However, in the second preferred embodiment, the developing solution dispensing nozzle 11 is never inclined at an angle, and therefore, the angle $\alpha$ is always 0 degree both while the developing solution dispensing nozzle 11 is moving forward in the scanning direction A and while the developing solution dispensing nozzle 11 is moving back in the scanning direction D.

Further, with respect to a condition in which the developing solution is dispensed from the developing solution dispensing nozzle 11 as well, as in the first preferred embodiment, drops of the developing solution join together into the shape of a band along the slit-like dispensing opening 15 (See FIGS. 8A and 8B)

The developing apparatus according to the second preferred embodiment as well achieves a similar effect to that of the first preferred embodiment, except for the effect which is realized by the structure that the dispensing direction for dispensing the developing solution is tilted opposite to the scanning direction of the developing solution dispensing nozzle 11. While the developing apparatus according to the first preferred embodiment requires that the dispensing direction for dispensing the developing solution is inclined opposite to the scanning direction of the developing solution dispensing nozzle 11 so that a flow of the developing solution in the scanning direction is suppressed while a flow of the developing solution in the opposite direction to the scanning direction is induced, to thereby achieve the effect of improving the uniformity of development and suppressing development defects which are created because of fine air bubbles, the developing apparatus according to the second preferred embodiment achieves a similar effect since the developing solution dispensing nozzle 11 has the configuration as that shown in FIG. 10.

That is, the bottom surface portion 22*a* of the nozzle main body portion 22 of the developing solution dispensing nozzle 11 is a flat surface which is parallel to a substrate 100, the developing solution which is dispensed at the slit-like dispensing opening 15 onto a substrate 100 spreads out along the gap between the bottom surface portion 22*a* and the substrate 100 as the surface tension of the developing solution decreases, so that the developing solution is supplied uniformly on the substrate 100. As a result, the uniformity of development is improved.

In addition, since the bottom surface portion 22*a* of the nozzle main body portion 22 is formed by a hydrophilic material, a sufficient quantity of a solution pool is formed on the bottom surface portion 22*a* before the developing solution dispensing nozzle 11 reaches an edge of a substrate 100. This prohibits a top surface of the substrate 100 from having a portion which is not provided with the developing solution, and therefore, improves the uniformity of development.

Further, since the side wall surface of the developing solution dispensing nozzle 11 which is adjacent to at least the bottom surface portion 22*a* is water-repellent, the developing solution is prevented from crawling up to the side wall surface of the developing solution dispensing nozzle 11, and therefore, vibration of the developing solution is suppressed in a portion (which is denoted at S in FIG. 10) where the developing solution contacts the substrate 100 ahead in the scanning direction of the developing solution dispensing nozzle 11. This avoids entanglement of very fine air bubbles (i.e., micro-bubbles) at the portion S, thereby suppressing creation of development defects due to adhesion of the air bubbles. In addition, since the developing solution does not crawl up to the side wall surface of the developing solution dispensing nozzle 11, only the bottom surface portion 22*a* needs be cleaned during cleaning of the nozzle, which simplifies a cleaning mechanism.

Moreover, since the area of the water-repellent layer 20 which is adjacent to at least the bottom surface portion 22*a* is the inclined surface 20*a*, the developing solution is prevented from flowing in the scanning direction of the developing solution dispensing nozzle 11 ahead of the scanning, and the uniformity of development is accordingly improved.

<C. Modification>

While the developing solution dispensing nozzle 11 starts to dispense the developing solution at the scanning start positions P1, R1 in the preferred embodiments above, the dispensing of the developing solution may be started at a position between the scanning start positions P1, R1 and an edge of a substrate 100 after the developing solution dispensing nozzle 11 starts scanning.

Further, although the dispensing of the developing solution is stopped at a position between an edge of a substrate 100 and the scanning stop positions P3, R3 after the developing solution dispensing nozzle 11 passes over the substrate 100 in the preferred embodiments above, the dispensing of the developing solution may be stopped at the scanning stop positions P3, R3.

Still further, although the substrate transport apparatus 300 functions as substrate replacing means in the preferred embodiments above, other substrate replacing means may be used.

While the invention has been described in detail, the foregoing description is in all aspects illustrative and not restrictive. It is understood that numerous other modifications and variations can be devised without departing from the scope of the invention.

We claim:

1. An apparatus for supplying a developing solution to a substrate and performing developing processing, comprising:

a) substrate holding means for holding substrate horizontally;

b) a developing solution dispensing nozzle for dispensing a developing solution onto said substrate;

c) moving means for reciprocally moving said developing solution dispensing nozzle over said substrate which is held still by said substrate holding means, between a one side position off said substrate and an other side position off said substrate; and d) control means for controlling said developing solution dispensing nozzle to dispense or stop dispensing said developing solution wherein said developing solution dispensing nozzle comprises a bottom surface which is parallel to a substrate which is held still by said substrate holding means and said bottom surface is formed by a hydrophilic material.

2. The apparatus of claim 1, wherein a side wall surface of said developing solution dispensing nozzle which is adjacent to said bottom surface is formed by a water-repellent material.

3. The apparatus of claim 2, wherein said side wall surface is inclined so that an angle between said side wall surface and a substrate which is held still by said substrate holding means is an acute angle.

4. The apparatus of claim 1, wherein said developing solution dispensing nozzle comprises a slit-like dispensing opening which is disposed in a horizontal direction, and said moving means moves said developing solution dispensing nozzle linearly in a direction which is approximately perpendicular to said slit-like dispensing opening.

5. The apparatus of claim 4, wherein said developing solution dispensing nozzle moves over a substrate which is held by said substrate holding means while keeping a constant distance 5 mm or shorter between a top surface of said substrate and said slit-like dispensing opening.

6. The apparatus of claim 5, wherein the length of said slit-like dispensing opening of said developing solution dispensing nozzle is equal to or longer than the diameter of a substrate which is held by said substrate holding means.

7. The apparatus of claim 6, wherein said control means makes said developing solution dispensing nozzle starts dispensing said developing solution in such a manner that said developing solution falls down like a curtain from said slit-like dispensing opening, before said developing solution dispensing nozzle reaches over a substrate which is held by said substrate holding means.

8. A developing method of dispensing a developing solution at a developing solution dispensing nozzle and supplying said developing solution onto a substrate which is held by substrate holding means, comprising the steps of:

a) moving said developing solution dispensing nozzle over a substrate which is held still by said substrate holding means, from a one side position off said substrate to an other side position off said substrate, and supplying said developing solution onto said substrate from said developing solution dispensing nozzle;

b) replacing said substrate which is held by said substrate holding means with other substrate after said developing solution dispensing nozzle is moved; and c) after replacing said substrate, moving said developing solution dispensing nozzle over said other substrate which is held still by said substrate holding means, from said other side position off said other substrate to said one side position off said other substrate, and supplying said developing solution onto said other substrate from said developing solution dispensing nozzle.

9. The method of claim 8, wherein said developing solution dispensing nozzle comprises a bottom surface which is parallel to a substrate which is held still by said substrate holding means.

10. The method of claim 9, wherein said bottom surface is formed by a hydrophilic material, and a side wall surface of said developing solution dispensing nozzle which is adjacent to said bottom surface is formed by a water-repellent material.

11. The method of claim 8, further comprising the step of d) changing a dispensing direction in which said developing solution dispensing nozzle dispenses said developing solution, between said step a) and said step c).

12. The method of claim 11, wherein said dispensing direction in which said developing solution dispensing nozzle dispenses said developing solution is inclined toward an opposite direction to a traveling direction of said developing solution dispensing nozzle from a vertical downward direction.

13. An apparatus for applying predetermined processing, including developing processing, to a substrate, comprising:

a) substrate holding means for holding a substrate horizontally;

b) a developing solution dispensing nozzle for dispensing a developing solution onto said substrate;

c) moving means for reciprocally moving said developing solution dispensing nozzle over a substrate which is held still by said substrate holding means, between a one side position off said substrate and an other side position off said substrate;

d) control means for controlling said developing solution dispensing nozzle to dispense or stop dispensing said developing solution while said developing solution dispensing nozzle is moved forward and backward by said moving means; and e) substrate replacing means for replacing a substrate which is held by said substrate holding means, between when said developing solution dispensing nozzle is moved forward by said moving means and when said developing solution dispensing nozzle is moved backward by said moving means.

14. An apparatus for supplying a developing solution to a substrate and performing developing processing, comprising:

a) substrate holding means for holding a substrate horizontally;

b) a developing solution dispensing nozzle for dispensing a developing solution onto said substrate;

c) moving means for reciprocally moving said developing solution dispensing nozzle over said substrate which is held still by said substrate holding means, between a one side position off said substrate and an other side position off said substrate; and d) control means for controlling said developing solution dispensing nozzle to dispense or stop dispensing said developing solution when said developing solution dispensing nozzle is moved forward by said moving means and when said developing solution dispensing nozzle is moved backward by said moving means.

15. The apparatus of claim 14, wherein said moving means moves said developing solution dispensing nozzle over said substrate, from said one side position to said other side position, and after said substrate which is held by said substrate holding means is replaced with other substrate, said moving means moves said developing solution dispensing nozzle over said other substrate from said other side position to said one side position.

16. The apparatus of claim 15, further comprising:

e) dispensing direction changing means for changing a dispensing direction in which said developing solution dispensing nozzle dispenses said developing solution, between when said developing solution dispensing nozzle is moved forward by said moving means and when said developing solution dispensing nozzle is moved backward by said moving mean.

17. The apparatus of claim 16, wherein said dispensing direction changing means tilts said dispensing direction, in which said developing solution dispensing nozzle dispenses said developing solution to an opposite direction to a traveling direction of said developing solution dispensing nozzle from a vertical downward direction.

18. The apparatus of claim 14, wherein said developing solution dispensing nozzle comprises a slit-like dispensing opening which is disposed in a horizontal direction, and said moving means moves said developing solution dispensing nozzle linearly in a direction which is approximately perpendicular to said slit-like dispensing opening.

19. The apparatus of claim 18, wherein said developing solution dispensing nozzle moves over a substrate which is held by said substrate holding means while keeping a constant distance 5 mm or shorter between a top surface of said substrate and said slit-like dispensing opening.

20. The apparatus of claim 19, wherein the length of said slit-like dispensing opening of said developing solution dispensing nozzle is equal to or longer than the diameter of a substrate which is held by said substrate holding means.

21. The apparatus of claim 20, wherein said control means makes said developing solution dispensing nozzle starts dispensing said developing solution in such a manner that said developing solution falls down like a curtain from said slit-like dispensing opening, before said developing solution dispensing nozzle reaches over a substrate which is held by said substrate holding means.

* * * * *